US007451837B2

(12) United States Patent
Hoffmaster et al.

(10) Patent No.: US 7,451,837 B2
(45) Date of Patent: Nov. 18, 2008

(54) ADVANCED EXPANDABLE REAMING TOOL

(75) Inventors: Carl M. Hoffmaster, Houston, TX (US); David K. Truax, Houston, TX (US); Timothy P. Beaton, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 97 days.

(21) Appl. No.: 10/774,134

(22) Filed: Feb. 6, 2004

(65) Prior Publication Data

US 2004/0154836 A1 Aug. 12, 2004

Related U.S. Application Data

(62) Division of application No. 09/924,961, filed on Aug. 8, 2001.

(51) Int. Cl.
*E21B 7/28* (2006.01)
*E21B 10/32* (2006.01)

(52) U.S. Cl. ..... 175/263; 175/406

(58) Field of Classification Search ..... 175/406, 175/263, 426, 401; 166/55.6, 55.7, 55.8
See application file for complete search history.

(56) References Cited

U.S. PATENT DOCUMENTS 2,644,670 A * 7/1953 Baker et al. ..... 175/426
2,823,901 A 2/1958 Kammerer
4,431,065 A * 2/1984 Andrews ..... 175/269
4,589,504 A * 5/1986 Simpson ..... 175/267
4,809,793 A 3/1989 Hailey
5,174,374 A * 12/1992 Hailey ..... 166/55.8
5,341,888 A 8/1994 Deschutter
5,402,856 A * 4/1995 Warren et al. ..... 175/57
5,607,025 A 3/1997 Mensa-Wilmot et al.

(Continued)

FOREIGN PATENT DOCUMENTS

EP 0 266 864 A2 5/1988

(Continued)

OTHER PUBLICATIONS

Examiner's Action issued on corresponding Canadian Application No. 2,397,110; Dated Mar. 14, 2006; (3 pages).

(Continued)

*Primary Examiner*—Hoang Dang
(74) *Attorney, Agent, or Firm*—Osha • Liang LLP

(57) ABSTRACT

An expandable reaming tool including at least two reamer pads connected to a tool body. The reamer pads are adapted to be displaced between a retracted position and an expanded position. At least one spiral blade is formed on at least one reamer pad. A plurality of cutting elements are disposed on the at least one spiral blade.

An expandable reaming tool including at least two reamer pads connected to a tool body. The reamer pads are adapted to be displaced between a retracted position and an expanded position. At least one spiral blade is formed on at least one reamer pad. A plurality of cutting elements are disposed on the at least one blade and at least one gage protection element is disposed on a gage surface of the at least one blade. The plurality of cutting elements are arranged so as to enable the expandable reaming tool to backream a formation in a wellbore.

18 Claims, 6 Drawing Sheets

U.S. PATENT DOCUMENTS

| | | | | | |
|---|---|---|---|---|---|
| 5,788,000 | A | * | 8/1998 | Maury et al. | 175/325.1 |
| 5,853,054 | A | * | 12/1998 | McGarian et al. | 175/267 |
| 5,957,223 | A | * | 9/1999 | Doster et al. | 175/57 |
| 5,979,576 | A | * | 11/1999 | Hansen et al. | 175/399 |
| 6,006,845 | A | | 12/1999 | Illerhaus et al. | |
| 6,039,131 | A | | 3/2000 | Beaton | |
| 6,142,250 | A | * | 11/2000 | Griffin et al. | 175/381 |
| 6,269,893 | B1 | * | 8/2001 | Beaton et al. | 175/391 |
| 6,516,293 | B1 | * | 2/2003 | Huang et al. | 703/10 |

FOREIGN PATENT DOCUMENTS

| | | |
|---|---|---|
| EP | 0869256 | 10/1998 |
| EP | 1085167 | 3/2001 |
| GB | 834 870 A | 5/1960 |
| GB | 2351513 | 1/2001 |
| GB | 2352748 | 2/2001 |
| WO | WO-00/31371 A1 | 6/2000 |

OTHER PUBLICATIONS

European Patent Office Communication; Dated Feb. 3, 2006; Appl. No. 02 102 104.3-2314; (4 pages).

Canadian Official Action; Dated Jun. 7, 2005; Appl. No. 2,397,110; 3 pages.

European Patent Office Communication issued in European Application No. 07100899.9, dated Jun. 12, 2008 (5 pages).

European Office Action issued in corresponding EP Application No. 07 100 899.9-1266 dated Aug. 27, 2007 (8 pages).

* cited by examiner

ADVANCED EXPANDABLE REAMING TOOL

CROSS-REFERENCE TO RELATED APPLICATIONS

This application is a divisional application of U.S. Patent Application Ser. No. 09/924,961, entitled "Advanced Expandable Reaming Tool "filed on Aug.8, 2001, by Carl Hoffmaster et al., which is incorporated by reference in its entirety.

BACKGROUND OF INVENTION

1. Field of the Invention

The invention relates generally to cutting structures used to drill wells in the earth. More specifically, the invention relates to PDC cutting structures for expandable downhole reaming tools.

2. Background Art

Polycrystalline diamond compact (PDC) cutters have been used in industrial applications including rock drilling and metal machining for many years. In these applications, a compact of polycrystalline diamond (or other superhard material such as cubic boron nitride) is bonded to a substrate material, which is typically a sintered metal-carbide, to form a cutting structure. A compact is a polycrystalline mass of diamonds (typically synthetic) that are bonded together to form an integral, tough, high-strength mass.

An example of a use of PDC cutters is in a rock bit for earth formation drilling as disclosed in U.S. Pat. No. 5,186,268. FIG. 1 from that patent shows a cross section of a rotary drill bit having a bit body 10. A lower face of the bit body 10 is formed with a plurality of blades (blade 22 is shown in FIG. 1) that extend generally outwardly away from a rotational axis 15 of the drill bit. A plurality of PDC cutters 26 are disposed side by side along the length of each blade. The number of PDC cutters 26 carried by each blade may vary. The PDC cutters 26 are brazed to a stud-like carrier, which may also be formed from tungsten carbide, and is received and secured within a socket in the respective blade.

When drilling a typical well, a PDC bit is run on the end of a bottom hole assembly (BHA) and the PDC bit drills a wellbore with a selected diameter. However, there are limitations on the diameter of a wellbore that may be drilled with a conventional drill bit. For example, a wellbore may comprise steel casing that has already been set in the well. Therefore, the diameter of the drill bit attached to the BHA is limited by a "pass-though" diameter (e.g., a minimum required diameter through which the drill bit may pass, such as the internal diameter of the steel casing). Accordingly, several attempts have been made to design drill bits and downhole tools that can effectively "drill out" or "underream" a wellbore below, for example, casing that has been set in the wellbore.

Prior art underreamers are typically separate tools that are run into the wellbore in a separate trip. These underreamers require that the BHA (e.g., the BHA with the drill bit) be brought to the surface and exchanged with an underreaming BHA. This is a costly operation because of the time required to make an additional trip in and out of the well to exchange the standard BHA for the underreaming BHA, especially in offshore operations. Accordingly, efforts have been made to design downhole tools that could be run into the wellbore on a standard BHA and effectively "underream while drilling." Underreaming while drilling eliminates extra trips in and out of the wellbore and the associated rig downtime.

An example of such an attempt to develop an underreaming capable BHA is the development of the bi-center drill bit. A typical bi-center bit comprises a pilot section having an axis of rotation substantially coaxial with a rotational axis of the BHA. The bi-center bit also includes a reaming section, typically characterized by a blade arrangement that has a center of rotation that is offset from the rotational axis of the BHA. Rotation of the reaming section about the bit axis enables the bi-center bit to drill a larger diameter hole than would ordinarily be drilled by the gage diameter of the pilot bit section alone. Moreover, a particular advantage of the bi-center drill bit is that it has a pass-through diameter that is less than a drill diameter of the reaming section so that the bi-center bit can be passed through casing with a diameter smaller than a desired reamed diameter and then rotated so as to underream the formation beneath the casing. An example of a bi-center bit is shown in U.S. Pat. No. 6,039,131 issued to Beaton.

Another device that has been developed is the near-bit reamer. Near-bit reamers may be run into a wellbore with typical steerable BHAs, and the near-bit reamers are generally activated downhole by, for example, hydraulic pressure. When activated, a pressure differential is created between an internal diameter of the reamer and a wellbore annulus. The higher pressure inside the reamer activates pistons that radially displace a reamer cutting structure. The reamer cutting structure is typically symmetrical about a wellbore axis, including, for example, expandable pads that comprise cutting elements. The cutting elements are moved into contact with formations already drilled by the drill bit, and the near-bit reamer expands the diameter of the wellbore by a preselected amount defined by a drill diameter of the expanded reamer outing structure.

Prior art near-bit reamers generally include cutting structures that are fairly rudimentary in design. While PDC cutters are commonly used with near-bit reamers, the PDC cutters are generally arranged in a relatively simplistic fashion. Therefore, it would be advantageous to produce near-bit reamer cutting structures that incorporate, for example, advanced cutting structures used on PDC drill bits.

SUMMARY OF INVENTION

In one aspect, the invention comprises an expandable reaming tool comprising at least two reamer pads operatively coupled to a tool body and adapted to be displaced between a retracted position and an expanded position. At least one spiral blade is formed on at least one reamer pad, and a plurality of cutting elements are disposed on the at least one spiral blade.

In another aspect, the invention comprises an expandable reaming tool, comprising at least two reamer pads operatively coupled to a tool body and adapted to be displaced between a retracted position and an expanded position. At least one blade is formed on the at least two reamer pads and a plurality of cutting elements are disposed on the at least one blade. At least one gage protection element is disposed on a gage surface of the at least one blade, and the plurality of cutting elements are arranged so as to enable the expandable reaming tool to backream a formation in a wellbore.

In another aspect, the invention comprises an expandable reaming tool, comprising at least two reamer pads operatively coupled to a tool body and adapted to be displaced between a retracted position and an expanded position. At least one blade formed on each of the at least two reamer pads and a plurality of cutting elements disposed on the blades. The plurality of cutting elements are arranged so as to substantially balance axial forces between the at least two reamer pads.

In another aspect, the invention comprises an expandable reaming tool, comprising at least two reamer pads operatively coupled to a tool body and adapted to be displaced between a retracted position and an expanded position. At least one blade formed on each of the at least two reamer pads and a plurality of cutting elements disposed on the blades. The plurality of cutting elements are arranged so that a net lateral force acting on the at least two reamer pads is substantially zero.

In another aspect, the invention comprises an expandable reaming tool, comprising at least two reamer pads operatively coupled to a tool body and adapted to be displaced between a retracted position and an expanded position. At least one blade formed on each of the at least two reamer pads and a plurality of cutting elements disposed on the blades. The plurality of cutting elements are arranged so as to substantially balance work performed between the at least two reamer pads.

In another aspect, the invention comprises an expandable reaming tool, comprising at least two reamer pads operatively coupled to a tool body and adapted to be displaced between a retracted position and an expanded position. At least one blade formed on each of the at least two reamer pads and a plurality of cutting elements disposed on the blades. The at least two reamer pads are adapted to substantially mass balance the reaming tool about an axis of rotation thereof.

In another aspect, the invention comprises an expandable reaming tool, comprising at least two reamer pads operatively coupled to a tool body and adapted to be displaced between a retracted position and an expanded position. At least one blade formed on each of the at least two reamer pads and a plurality of cutting elements disposed on the blades. The plurality of cutting elements are positioned to each have a backrake angle of greater than 20 degrees.

In another aspect, the invention comprises an expandable reaming tool, comprising at least two reamer pads operatively coupled to a tool body and adapted to be displaced between a retracted position and an expanded position. At least one blade formed on each of the at least two reamer pads and a plurality of cutting elements disposed on the blades. Each of the plurality of cutting elements has a diameter of less than 13 mm or greater than 13 mm.

In another aspect, the invention comprises an expandable reaming tool, comprising at least two reamer pads operatively coupled to a tool body and adapted to be displaced between a retracted position and an expanded position. At least one blade formed on each of the at least two reamer pads and a plurality of cutting elements disposed on selected surfaces of the blades. The selected surfaces are shaped so that a cutting element exposure is equal to at least half of a diameter of the cutting element.

In another aspect, the invention comprises an expandable reaming tool, comprising at least two reamer pads operatively coupled to a tool body and adapted to be displaced between a retracted position and an expanded position. At least one blade formed on each of the at least two reamer pads and a plurality of cutting elements disposed on the blades. Selected ones of the plurality of cutting elements disposed on one of the at least two reamer pads are positioned so as to form a redundant cutting arrangement with other selected ones of the plurality of cutting elements disposed on a different one of the at least two reamer pads.

In another aspect, the invention comprises an expandable reaming tool comprising at least two reamer pads operatively coupled to a tool body and adapted to be displaced between a retracted position and an expanded position. At least one blade is formed on each of the at least two reamer pads and a plurality of cutting elements are disposed on the blades. The at least two reamer pads and the at least one blade are formed from a non-magnetic material.

In another aspect, the invention comprises an expandable reaming tool comprising at least two reamer pads operatively coupled to a tool body and adapted to be displaced between a retracted position and an expanded position. At least one blade is formed on each of the at least two reamer pads and a plurality of cutting elements are disposed on the blades. The at least two reamer pads and the at least one blade are formed from a matrix material infiltrated with a binder alloy.

In another aspect, the invention comprises an expandable reaming tool comprising at least two reamer pads operatively coupled to a tool body and adapted to be displaced between a retracted position and an expanded position. At least one blade is formed on each of the at least two reamer pads and a plurality of cutting elements are disposed on the blades. A perpendicular distance measured from a surface of the at least two reamer pads to an outermost extent of a gage cutting element disposed on the at least one spiral blade is equal to at least twice a diameter of the gage cutting element.

In another aspect, the invention comprises an expandable reaming tool comprising at least two reamer pads operatively coupled to a tool body and adapted to be displaced between a retracted position and an expanded position. At least one blade is formed on each of the at least two reamer pads and a plurality of cutting elements are disposed on the blades. The at least one blade comprises a hardfacing material.

In another aspect, the invention comprises an expandable reaming tool comprising at least two reamer pads operatively coupled to a tool body and adapted to be displaced between a retracted position and an expanded position. At least one blade is formed on each of the at least two reamer pads and a plurality of cutting elements are disposed on the blades. The at least one blade comprises a diamond impregnated material.

In another aspect, the invention comprises an expandable reaming tool comprising at least two reamer pads operatively coupled to a tool body and adapted to be displaced between a retracted position and an expanded position. At least one blade is formed on each of the at least two reamer pads and a plurality of cutting elements are disposed on the blades. The plurality of cutting elements are arranged so as to form a tapered cutting structure.

Other aspects and advantages of the invention will be apparent from the following description and the appended claims.

DETAILED DESCRIPTION

Figure 1:
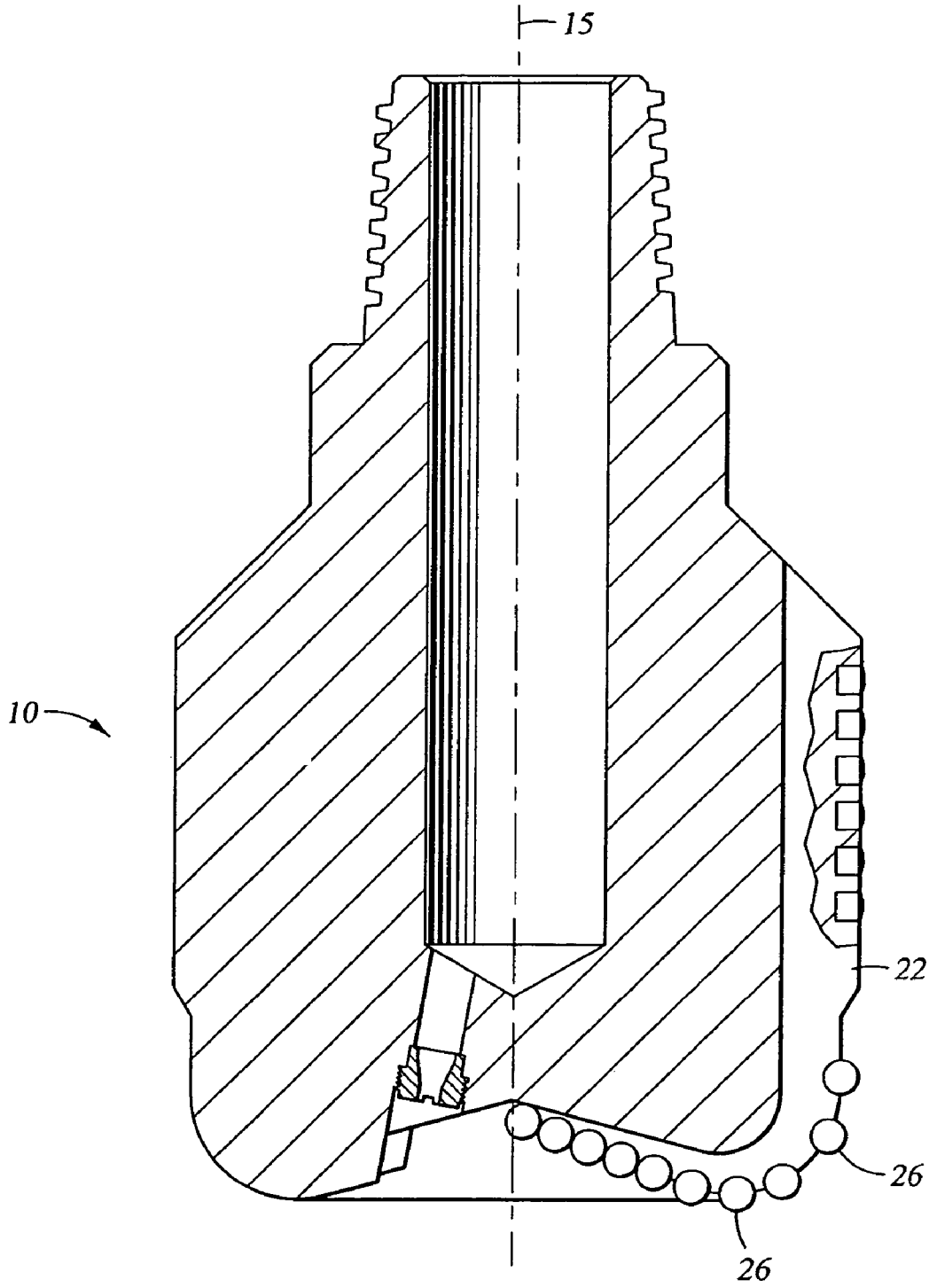
Fig. 1 (PRIOR ART)
FIG. 1 shows a prior art PDC drill bit.
Figure 2:
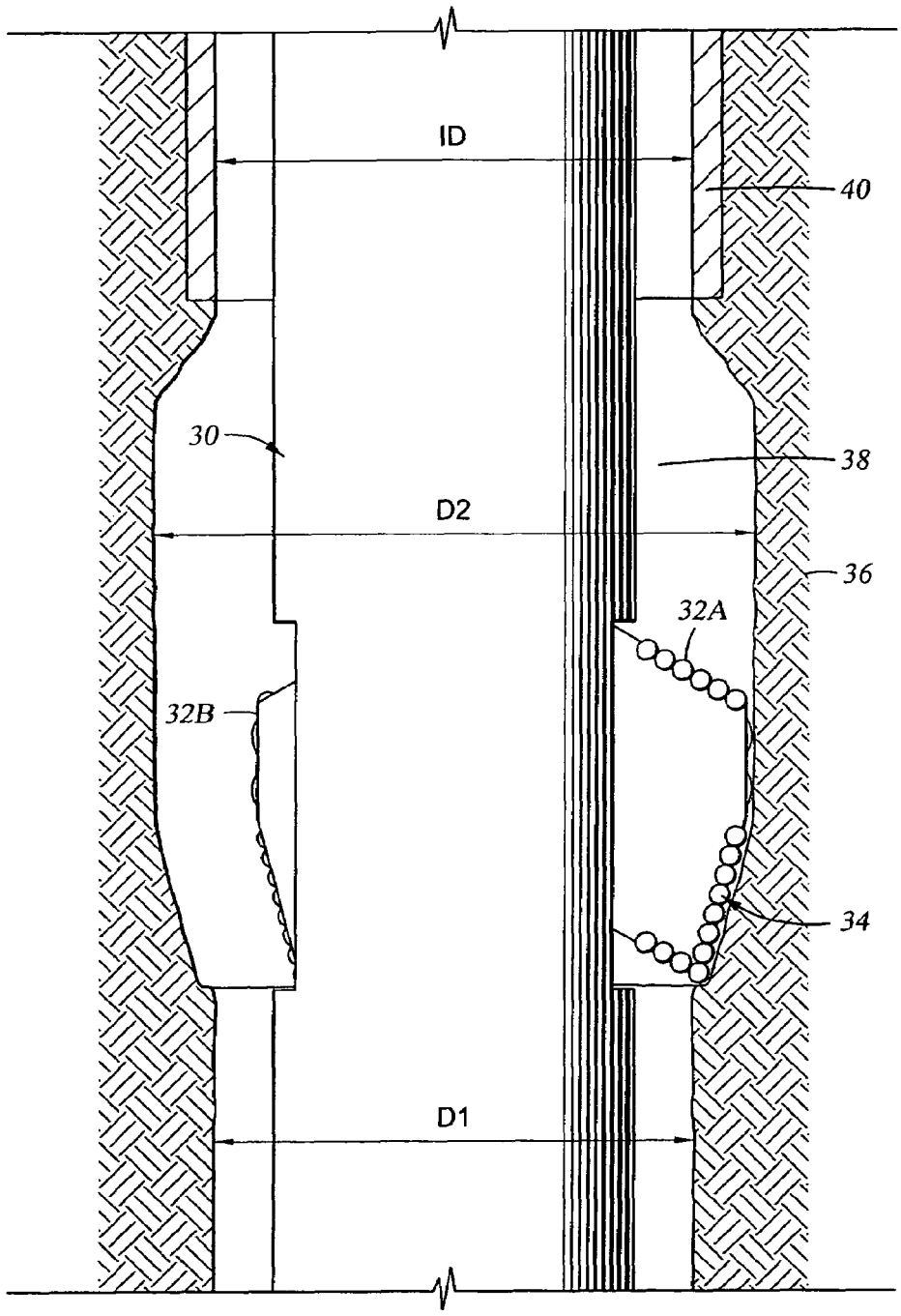
FIG. 2 shows a side view of an embodiment of the invention.

FIG. 2 shows a general configuration of a reaming tool that includes one or more aspects of the present invention. Expandable reamer pads 32A (shown in an expanded position), 32B (shown in a retracted position) are operatively attached to a downhole expandable reaming tool 30. The reamer pads 32A, 32B comprise cutting structures 34 and may be activated from the retracted position (e.g., 32B) to the expanded position (e.g., 32A) by, for example, hydraulic actuation, mechanical actuation, or any similar actuation method known in the art. The method of actuation and operative attachment to the reaming tool 30 is not intended to limit the scope of the invention. Moreover, the discussion below includes a description of how a reamer pad in an expanded position underreams a wellbore. It should be understood that the description of the operation of a single reaming pad should not be limiting and that the description is provided to clarify the operation of the invention.

When the reamer pad 32A contacts a formation 36 at a wall of the wellbore 38, cutting elements on the cutting structure 34 on the reamer pad 32A underreams the wellbore 38 to a reamed diameter D2. The reamed diameter D2 is generally larger than, for example, a previously drilled diameter D1 (wherein, for example, the previously drilled diameter D1 is defined by a gage diameter of a drill bit (not shown) positioned some axial distance ahead of the reaming tool 30). The previously drilled diameter D1 may be approximately equal to an internal diameter ID of a length of casing 40 positioned in the wellbore 38 above the underreamed portion of the wellbore 38.

Figure 3:
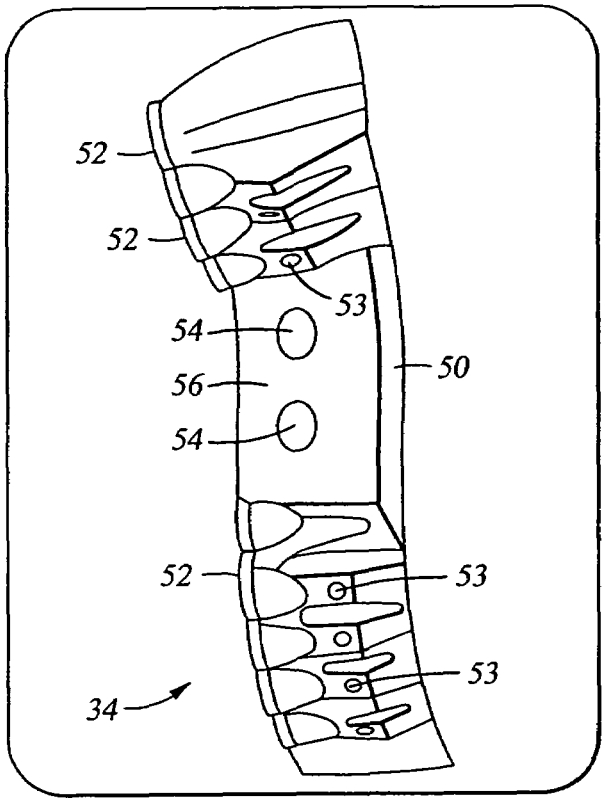
FIG. 3 shows a side view of a reamer pad in an embodiment of the invention.

One embodiment of the invention is shown in FIG. 3. The cutting structure 34 comprises a spiral blade 50 configuration. A plurality of cutting elements 52 are positioned on the blade 50 and are arranged to underream the wellbore (38 in FIG. 3) when the reamer pad 32A is in the expanded position. The cutting elements 52 may be, for example, polycrystalline diamond compact (PDC) inserts, tungsten carbide inserts, boron nitride inserts, and other similar inserts known in the art.

In one aspect, the invention comprises at least one spiral blade (a single spiral blade 50 is shown in the Figure) formed on at least one of the reamer pads (e.g., reamer pad 32A). However, more than one spiral blade may be disposed on any one or all of the reamer pads. For example, each reamer pad may comprise two azimuthally spaced apart spiral blades. Further, in other embodiments according to this aspect of the invention, any other blade may be straight, and any one of the reamer pads 32A may include more than one straight blade thereon. Accordingly, the embodiment shown in FIG. 3 is intended to illustrate one aspect of the invention (e.g., a spiral blade) and is not intended to be limiting with respect to, for example, a number of blades or a type of blade (e.g., spiral versus straight) on any other reamer pad.

In some embodiments, the reamer pad 32A may further comprise at least one gage protection insert on a gage diameter surface thereof, and preferably includes a plurality of gage inserts, as shown generally at 54. In the embodiment of FIG. 3, the plurality of gage inserts 54 are positioned to protect a gage surface 56 of the spiral blade 50 and to contact the wellbore (38 in FIG. 2) at the gage diameter of the expanded reamer pad 32A. The gage inserts 54 may comprise, for example, PDC inserts, thermally stabilized polycrystalline (TSP) inserts, diamond inserts, etc. Moreover, in other embodiments, the gage surface 56 of the reamer pad 32A (in addition to other portions of the cutting structure 34) may be coated with hardfacing materials or may be formed from, for example, diamond impregnated matrix materials or plain matrix materials. The hardfacing and/or matrix materials provide additional wear resistance from, for example, contact with the formation and/or erosion from a flow of drilling fluid in the wellbore (38 in FIG. 2).

In another embodiment, at least one and preferably a plurality of vibration damping inserts (53 in FIG. 3) are positioned proximate the cuffing elements (52 in FIG. 3) to reduce vibration when the reaming tool (30 in FIG. 2) is underreaming the wellbore (38 in FIG. 2). The vibration damping inserts (53 in FIG. 3) comprise inserts that that are attached to the reamer pad (32A in FIG. 3) and are adapted to limit instantaneous penetration of the cutting elements (52 in FIG. 3) in the formation. The vibration damping inserts (53 in FIG. 3) prevent the cutting elements (52 in FIG. 3) from taking large "bites" (e.g., from penetrating past a selected depth in the formation (36 in FIG. 2)) and binding, or "torquing up" the BHA. Vibration damping inserts (53 in FIG. 3) also help protect the blade (50 in FIG. 3) structure from impact damage when underreaming the wellbore (38 in FIG. 2).

In other embodiments, the cutting elements 52 may comprise different diameter cutting elements. For example, 13 mm cutting elements are commonly used with PDC drill bits. The cutting elements disposed on the reamer pads may comprise 13 mm cutters or any other diameter cutting element known in the art (e.g., other cutting element sizes include 9 mm, 11 mm, 16 mm, 19 mm, 22 mm, and/or 25 mm cutters, among other diameters). Further, different diameter cutting elements may be used on a single reamer pad (e.g., the diameter of cutting elements maybe selectively varied along a length of a blade).

The cutting elements 52 may be positioned at selected backrake angles according to another aspect of the invention. A common backrake angle used in prior art PDC reamers is about 20 °. However, the cutting elements in various embodiments according to this aspect of the invention may be positioned a backrake angles of greater than 20 °. Moreover, the backrake angle of the cutting elements may be varied. In one embodiment, the backrake angle is variable along the length of the blade. In a particular embodiment, the backrake angle of each cutting element is related to the axial position of the particular cutting element along the length of the blade.

In some embodiments, the reamer pads and the blades may be formed from non-magnetic materials (e.g., such as monel, etc.). In other embodiments, the reamer pads and blades may be formed from materials that comprise a matrix infiltrated with binder materials. Examples of these infiltrated materials may be found in, for example, U.S. Pat. No. 4,630,692 issued to Ecer and U.S. Pat. No. 5,733,664 issued to Kelley et al. These materials are advantageous because they are highly resistant to erosive and abrasive wear, yet are tough enough to withstand shock and stresses associated harsh drilling conditions.

Figure 4:
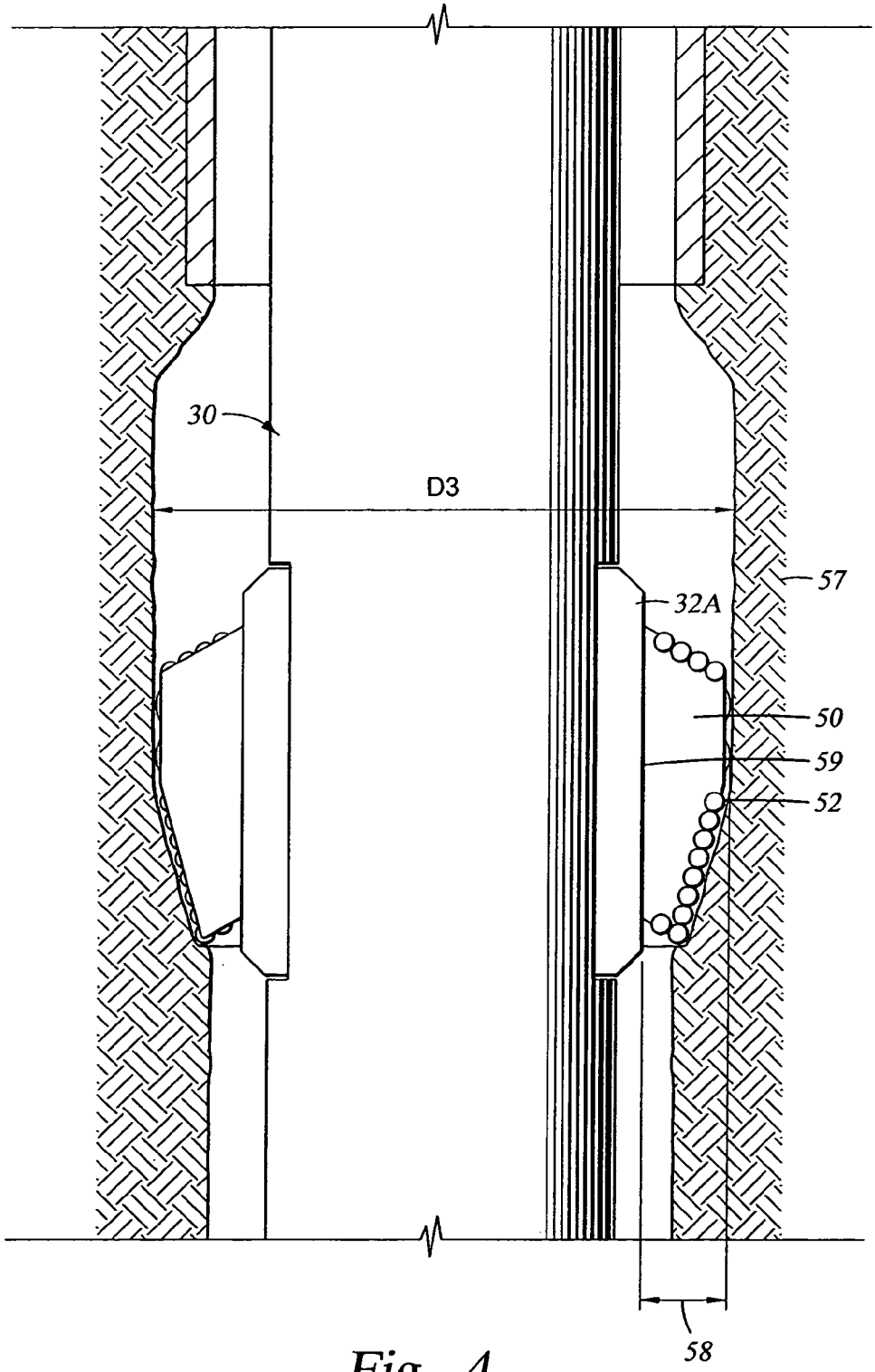
FIG. 4 shows a blade standoff in an embodiment of the invention.

In some embodiments, a distance (58 in FIG. 4) from a body of the reamer pad (32A in FIG. 4) to an outer extent of a cutting element (52 in FIG. 4) positioned at a selected underreaming diameter (D3 in FIG. 4) on a blade (50 in FIG. 4) may be greater than twice the diameter of the cutting element. This distance (58 in FIG. 4), typically referred to as "blade standoff" defines, for example, a clearance between a formation (57 in FIG. 4) and a surface (59 in FIG. 4) of the reamer pad (32A in FIG. 4). A blade standoff (58 in FIG. 4) of, for example, at least two cutting element diameters may help improve circulation of drilling fluid around the reaming pads (32A in FIG. 4) and the cutting elements (52 in FIG. 4). Accordingly, cutting transport is improved and improved drilling fluid circulation also improves cutting element cooling. Improved cutting element cooling may help prevent heat checking and other degrading effects of friction produced by contact between the cutting elements (52 in FIG. 4) and the formation (57 in FIG. 4).

In other embodiments of the invention, a geometric configuration of the blade (50 in FIG. 3) may be adapted (e.g., a portion of the blade (50 in FIG. 3) may be shaped) to provide a maximum cutting element exposure. The exposure of the cutting elements (52 in FIG. 3), which may be defined as a portion of the cutting elements (52 in FIG. 3) extending beyond the blade (50 in FIG. 3), in some embodiments comprises at least half of a diameter of the cutting elements (52 in FIG. 3) (e.g., 7.0 mm for a 14.0 mm diameter cutting element). This aspect of the invention generally applies to cylindrical cutters having a round or an elliptical cross section. Other embodiments that include larger or smaller diameter cutting elements may comprise different exposures. For example, other embodiments of the invention comprise exposures of greater than half of a diameter of a cutting element.

An example of shaped blade surface is shown in FIG. 3 (refer to the shaped surface of the blade 50). Excess, or "dead," material between cutting elements has been removed so as to increase cutting element exposure. Maximizing cutting element exposure helps improve the longevity of the reamer pad (32A in FIG. 3) by ensuring that the cutting elements (52 in FIG. 3), rather than the blade (50 in FIG. 3) material, contacts and underreams the formation (not shown). Maximized exposure of cutting elements may also help prevent blade damage, cutting element breakage, etc.

Figure 5C:
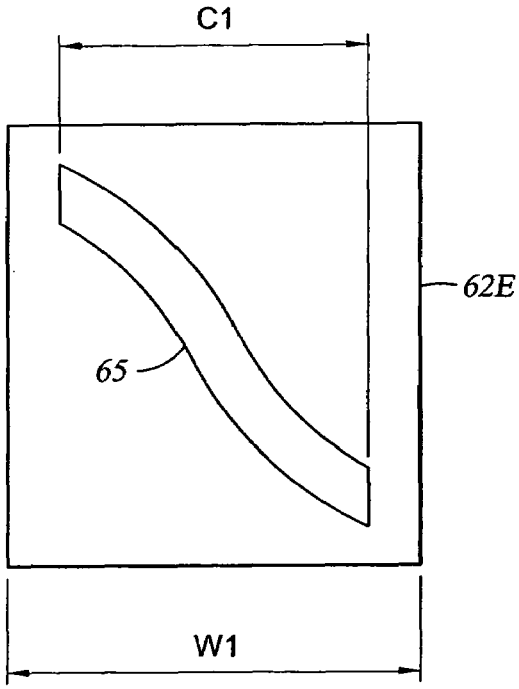
FIG. 5C shows a side view of a reamer pad of an embodiment of the invention.
Figure 5D:
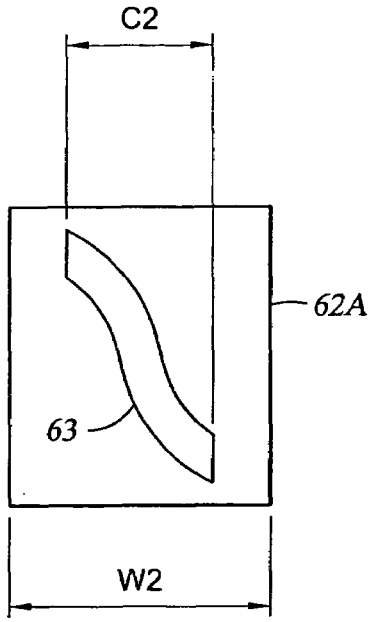
FIG. 5D shows a side view of a reamer pad of an embodiment of the invention.
Figure 5A:
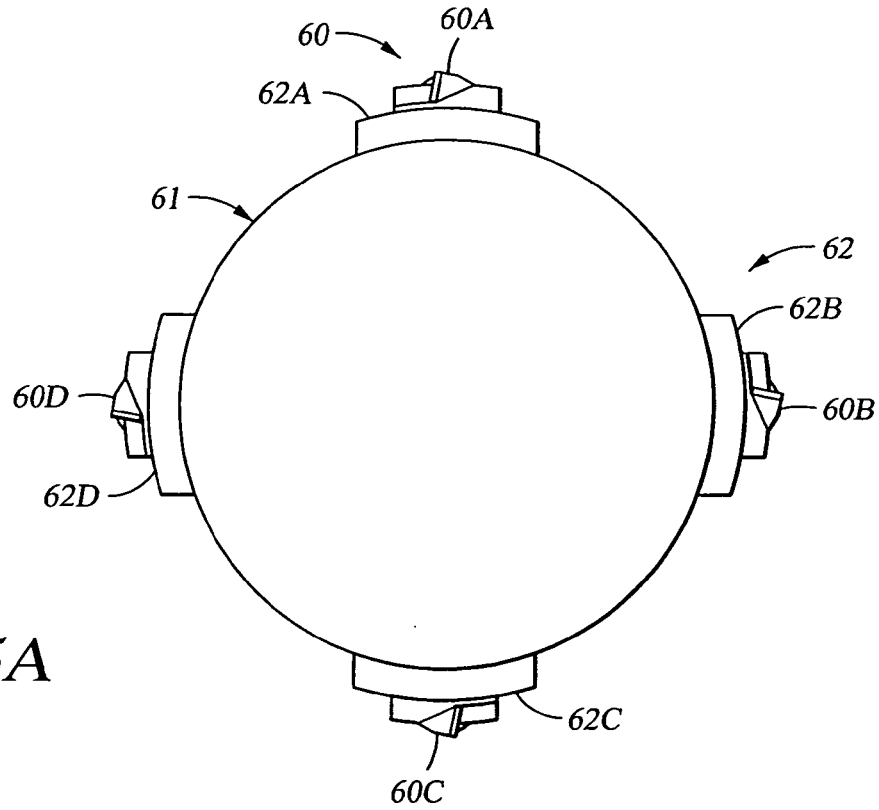
FIG. 5A shows a top sectional view of an embodiment of the invention.

In another embodiment of the invention shown in FIG. 5A, cutting elements 60 are arranged on reamer pads 62 so as to provide a redundant cutting structure for underreaming the wellbore 38. For example, this embodiment comprises four reamer pads 62 positioned about a perimeter of a reaming tool 61. Cutting element 60B may be referred to as being located in a position "trailing" cutting element 60A (wherein cutting element 60A may be referred to as being in a "leading" position with respect to cutting element 60B). Further, cutting element 60C may be referred to as being positioned in an "opposing" relationship with respect to cutting element 60A. In this manner, opposing cutting elements (such as 60A and 60C, or 60B and 60D) may be arranged to contact the wellbore (38 in FIG. 2) at substantially the same axial location, thereby providing a "redundant" cutting structure adapted to ensure efficient drilling of the wellbore (38 in FIG. 2). Moreover, trailing cutting elements may be positioned in a similar manner with respect to leading cutting elements. For example, cutting element 60D may be positioned so as to drill substantially the same formation as cutting element 60B. Moreover, redundant cutting structures may be formed from a plurality of cutting elements 60 disposed on different reamer pads 62. For example, selected ones of the cutting elements 60 on reamer pad 62B may be positioned in a redundant arrangement with selected other ones of the cutting elements 60 on reamer pad 62D. Other arrangements may also be used within the scope of the invention.

The embodiment shown in FIG. 5A comprises four reamer pads 62 wherein centerlines of the reamer pads 62 are positioned at approximately 90 degree intervals about a perimeter of the reaming tool 61. However, more or fewer reamer pads 62 may be used within the scope of the invention. For example, other embodiments of the invention may comprise three reamer pads wherein centerlines of the pads are positioned at approximately 120 degrees intervals about the perimeter of the reaming tool. Moreover reamer pads may be positioned at unequal angular intervals. For example, in a three pad embodiment, two pads may be positioned 90 degrees apart while the third pad is positioned 270 degrees from each of the other two pads. Alternatively, the three pads may be spaced at, for example, 90, 120, and 150 degrees intervals about the perimeter of the reaming tool. However, it is contemplated within the scope of the invention to have, for example, 90 degrees or less between centerlines of reamer pads so as to maximize cutting element coverage when underreaming the wellbore.

Figure 5B:
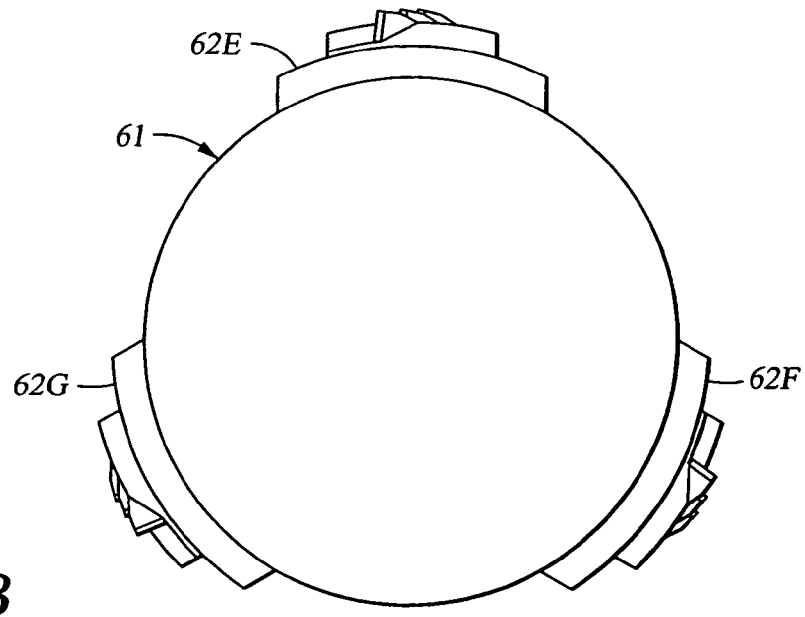
FIG. 5B shows a top sectional view of an embodiment of the invention.

Referring to FIG. 5B, if, for example, three reamer pads 62E, 62F, 62G are used, the three reamer pads 62E, 62F, 62G may be larger than the reamer pads 62A-62E shown in FIG. 5A so as to provide a similar area of coverage about the perimeter of the underreamer 61. The larger reamer pads 62E, 62F, 62G could also comprise, for example, multiple spiral blades disposed on each reamer pad 62E, 62F, 62G. Moreover, a circumferential extent of the spiral blade could also be increased because of the increased size of the reamer pads 62E, 62F, 62G. For example, a planar projection of reamer pad 62E (shown in FIG. 5C), when compared to a planar projection of reamer pad 62A (shown in FIG. 5D), indicates that reamer pad (62E in FIG. 5C) has a greater width (W1 in FIG. 5C) (e.g., arcuate sweep) than a comparable width (W2 in FIG. 5D) of reamer pad (62A in FIG. 5D). Accordingly, a circumferential extent (C1 in FIG. 5C) of a blade (65 in FIG. 5C) disposed on reamer pad (62E in Figure SC) may be greater than a circumferential extent (C2 in FIG. 5D) of a blade (63 in FIG. 5D) disposed on reamer pad (62A in FIG. 5D).

Cutting elements may be positioned on the respective reamer pads so as to balance a force or work distribution and provide a force or work balanced cutting structure. "Force balance" refers to a substantial balancing of axial force during drilling between cutting elements on the reaming pads, and force balancing has been described in detail in, for example, T. M. Warren et al., *Drag Bit Performance Modeling*, paper no. 15617, Society of Petroleum Engineers, Richardson, Tex. 1986. Similarly, "work balance" refers to a substantial balancing of work performed between the reamer pads and between cutting elements on the reamer pads.

The term "work" used to describe this aspect of the invention is defined as follows. A cutting clement on the reamer pads during underreaming cuts the earth formation through a combination of axial penetration and lateral scraping. The movement of the cutting element through the formation can thus be separated into a "lateral scraping" component and an "axial crushing" component. The distance that the cutting element moves laterally, that is, in the plane. of the bottom of the wellbore, is called the lateral displacement. The distance that the cutting element moves in the axial direction is called the vertical displacement. The force vector acting on the cutting element can also be characterized by a lateral force component acting in the plane of the bottom of the wellbore and a vertical force component acting along the axis of the drill bit. The work done by a cutting element is defined as the product of the force required to move the cutting element and the displacement of the cutting element in the direction of the force.

Thus, the lateral work done by the cutting element is the product of the lateral force and the lateral displacement. Similarly, the vertical (axial) work done is the product of the vertical force and the vertical displacement. The total work done by each cutting element can be calculated by summing the vertical work and the lateral work. Summing the total work done by each cutting element on any one reamer pad will provide the total work done by that reamer pad. In this aspect of the invention, the numbers of, and/or placement or other aspect of the arrangement of the cutting elements on each of the reamer pads can be adjusted to provide the reaming tool with a substantially balanced amount of work performed by each reamer pad.

Force balancing and work balancing may also refer to a substantial balancing of forces and work between cutting elements, between redundant cutting elements, etc. Balancing may also be performed over the entire reaming tool (e.g., over the entire cutting structure). In other embodiments, forces may be balanced so that there is a substantially zero net lateral force acting on the reaming tool (e.g., on the reamer pads) during drilling operations. Balancing to establish a substantially zero net lateral force helps ensure that the reaming tool maintains a desired trajectory without substantial lateral deviation when operating in a wellbore.

In other embodiments of the invention, reaming pads are adapted to substantially mass balance the reaming tool about an axis of rotation of the reaming tool. For example, substantially identical reamer pads may be arranged symmetrically about the axis of rotation. In other embodiments, asymmetric and/or non-identical blade arrangements and/or asymmetric reamer pad arrangements may be used to achieve mass balance about the axis of rotation. Mass balancing helps ensure that the reaming tool is dynamically stable and maintains a desired drilling and/or reaming trajectory.

Figure 6:
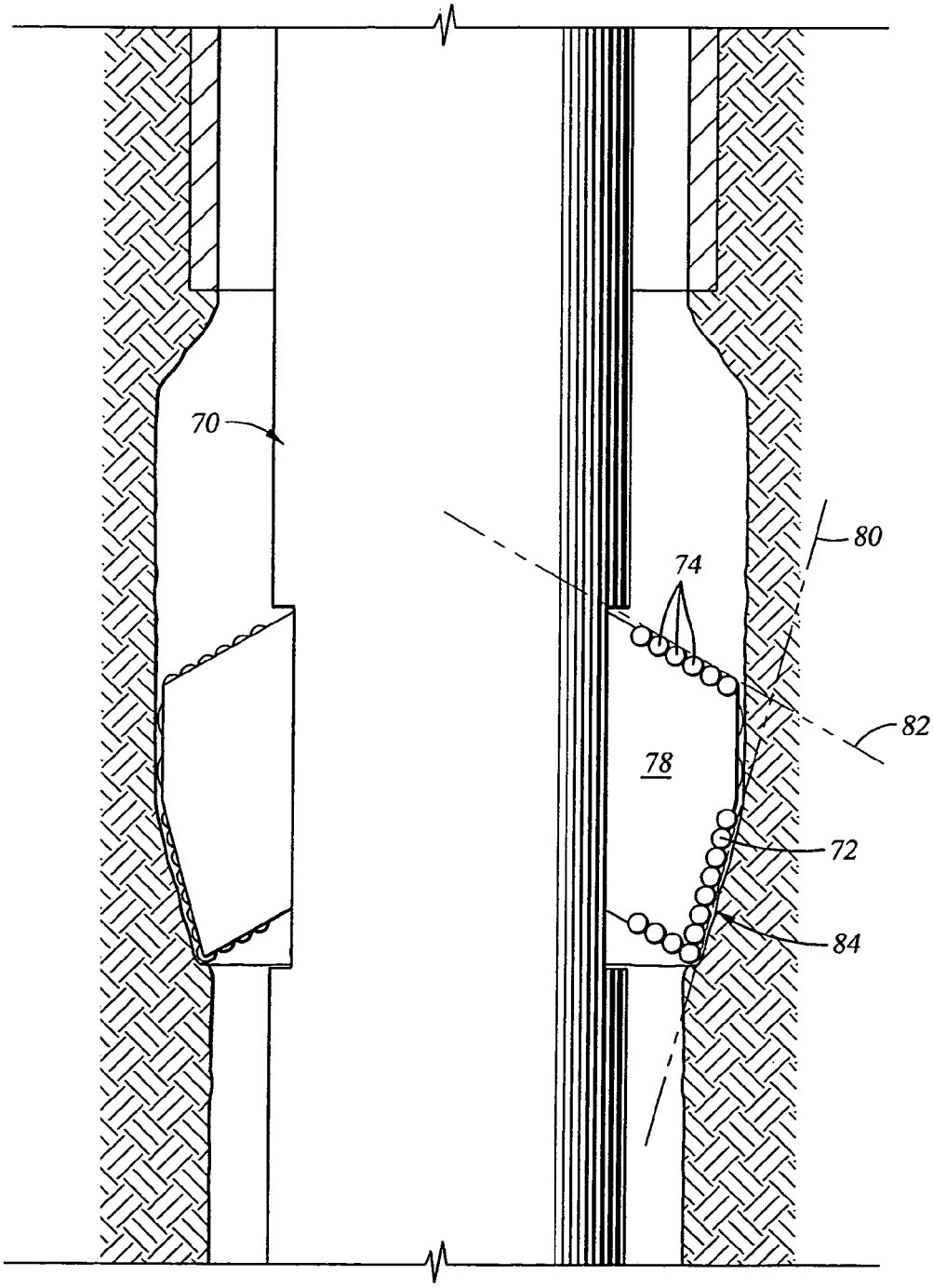
FIG. 6 shows a side view of an embodiment of the invention.

Another embodiment of the invention shown in FIG. 6 is backreaming capable. A reaming tool 70 comprises a plurality of cutting elements 72 disposed on reamer pads 78 and arranged to underream the wellbore (38 in FIG. 2) in the manner described with respect to, for example, the embodiments described above. However, the reamer pads 78 also comprise additional backreaming cutting elements 74 that are arranged to underream the wellbore (38 in FIG. 2) when the BHA (that includes the underreamer 70) is being pulled in an upward direction (e.g., when the reaming tool 70 is being pulled out of the wellbore (38 in FIG. 2)). For example, as the reaming tool 70 is run into the wellbore (38 in FIG. 2) while drilling, the plurality of cutting elements 72 are arranged to underream the wellbore (38 in FIG. 2) to a selected diameter. In this manner of operation, the backreaming cutting elements 74 do not typically contact the formation. However, when the BHA is then pulled out of the wellbore (e.g., toward the surface), the backreaming cutting elements 74 will effectively "drill out" any portion of the formation that has not previously been underreamed to the selected diameter.

Alternatively, the reaming tool 70 may be run into the wellbore (38 in FIG. 2) with the reamer pads 78 in the retracted position. Then, once the reaming tool 70 has been positioned at a selected depth, the reamer pads 78 may be expanded and the underreaming process may be completed as the reaming tool 70 is being pulled out of the wellbore (38 in FIG. 2). Therefore, the backreaming cutting elements 74 may serve a dual function because they both ensure that an underreamed portion of the wellbore (38 in FIG. 2) is reamed to the selected diameter and they enable the reaming tool 70 to operate while pulling out of the wellbore (38 in FIG. 2).

In other embodiments (as shown in FIG. 6), the cutting elements 72, 74 disposed on reamer pads 78 of a reaming tool 70 are arranged to form tapered cutting profiles 82, 84. In some embodiments, the cutting profiles 82, 84 may be substantially conical or substantially hemispherical. However, other tapered shapes may be used in other embodiments of the invention. For example, some embodiments comprise tapers wherein diameters of the reaming tool 70 subtended by cutting elements 72, 74 disposed on the reamer pads 78 are dependent upon an axial position of the cutting elements 72, 74 with respect to an axis of the reaming tool 70. Arrangement of the cutting elements 72, 74 in tapered cutting profiles 82, 84 enables the reaming tool 70 to gradually underream the formation (38 in FIG. 2) while drilling. Further, in some embodiments, the cutting elements 72 are disposed on the reamer pads 78 of the reaming tool 70 so as to form an angled cutting structure 84.

Advantageously, the advanced PDC cutting structures described above enable an expandable reaming tool to efficiently underream formations below, for example, casing set in a wellbore. Moreover, the advanced PDC cutting structures may optimize reaming parameters (such as rate of penetration) and decrease the time required to underream a wellbore to a desired diameter.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An expandable reaming tool, comprising:

at least two reamer pads operatively coupled to a tool body and configured to be displaced between a retracted position and an expanded position;

at least one spiral blade formed on at least one of the at least two reamer pads;

a plurality of cutting elements disposed on the at least one spiral blade, wherein the plurality of cuffing elements are arranged so as to substantially balance at least one parameter selected from axial force, lateral force, work, and mass between the at least two reamer pads, wherein the expandable reaming tool is configured to ream while drilling.

2. The expandable reaming tool of claim 1, wherein the plurality of cutting elements comprise at least one of polycrystalline diamond inserts, tungsten carbide inserts, and boron nitride inserts.

3. The expandable reaming tool of claim 1, further comprising at least one gage protection element disposed on a gage surface of the at least one spiral blade.

4. The expandable reaming tool of claim 3, wherein the at least one gage protection element comprises at least one of a thermally stabilized polycrystalline insert and a polycrystalline diamond insert.

5. The expandable reaming tool of claim 1, further comprising a vibration damping insert disposed on the at least one spiral blade.

6. The expandable reaming tool of claim 1, wherein the at least two reamer pads and the plurality of cuffing elements are arranged to backream a formation in a wellbore.

7. The expandable reaming tool of claim 1, wherein the plurality of cutting elements are arranged to form a tapered cutting structure.

8. The expandable reaming tool of claim 1, wherein the plurality of cutting elements have backrake angles of greater than 20 degrees.

9. The expandable reaming tool of claim 1, wherein selected ones of the plurality of cutting elements have different backrake angles than other ones of the plurality of cutting elements.

10. The expandable reaming tool of claim 1, wherein each of the plurality of cutting elements has a diameter of less than 13.0 mm or greater than 13.0 mm.

11. The expandable reaming tool of claim 1, wherein selected ones of the plurality of cutting elements disposed on one of the at least two reamer pads are positioned so as to form a redundant cutting arrangement with other selected ones of the plurality of cutting elements disposed on a different one of the at least two reamer pads.

12. The expandable reaming tool of claim 1, wherein the at least two reamer pads and the plurality of cutting elements are configured to substantially mass balance the expandable reaming tool about an axis of rotation of the reaming tool.

13. The expandable reaming tool of claim 1, wherein the at least two reamer pads and the at least one spiral blade are formed from a non-magnetic material.

14. The expandable reaming tool of claim 1, wherein the at least two reamer pads and the at least one spiral blade are formed from a matrix material infiltrated with a binder alloy.

15. The expandable reaming tool of claim 1, wherein surfaces of the at least one spiral blade proximate the plurality of cutting elements are shaped so that a cutting element exposure is equal to at least half of a diameter of the cutting element.

16. The expandable reaming tool of claim 1, wherein a perpendicular distance measured from a surface of the at least two reamer pads to an outermost extent of a gage cutting element disposed on the at least one spiral blade is equal to at least twice a diameter of the gage cutting element.

17. The expandable reaming tool of claim 1, wherein a gage surface of the at least one spiral blade comprises a hardfacing material.

18. The expandable reaming tool of claim 1, wherein a gage surface of the at least one spiral blade is formed from a diamond impregnated material.

* * * * *

UNITED STATES PATENT AND TRADEMARK OFFICE

CERTIFICATE OF CORRECTION

PATENT NO. : 7,451,837 B2
APPLICATION NO. : 10/774134
DATED : November 18, 2008
INVENTOR(S) : Carl M. Hoffmaster et al.

It is certified that error appears in the above-identified patent and that said Letters Patent is hereby corrected as shown below:

In Claim 6, column 10, line 50, "cuffing" should be --cutting--.

Signed and Sealed this

Twenty-fourth Day of February, 2009

JOHN DOLL
*Acting Director of the United States Patent and Trademark Office*